United States Patent [19]

Shay et al.

[11] Patent Number: 4,767,060

[45] Date of Patent: Aug. 30, 1988

[54] NOZZLE

[75] Inventors: Joseph J. Shay, Waterbury; John D. Daddio, North Branford, both of Conn.

[73] Assignee: Specialty Packaging Licensing Company, Wilmington, Del.

[21] Appl. No.: 58,392

[22] Filed: Jun. 5, 1987

[51] Int. Cl.[4] ..... B05B 7/10

[52] U.S. Cl. ..... 239/401; 239/403; 239/417; 239/428.5

[58] Field of Search ..... 239/333, 401, 403, 416, 239/416.5, 417, 417.5, 428.5, 541

[56] References Cited

U.S. PATENT DOCUMENTS

| | | | |
|---|---|---|---|
| 3,369,756 | 2/1968 | Ramis | 239/403 |
| 3,450,350 | 6/1969 | Gullaksen | 239/428.5 |
| 3,779,465 | 12/1973 | Jett et al. | 239/417 |
| 3,946,947 | 3/1976 | Schneider | 239/428.5 |
| 4,013,228 | 3/1977 | Schneider | 239/401 |
| 4,463,905 | 8/1984 | Stoesser et al. | 239/428.5 |
| 4,669,665 | 6/1987 | Shay | 239/428.5 |

*Primary Examiner*—Andres Kashnikow
*Assistant Examiner*—Michael J. Forman
*Attorney, Agent, or Firm*—Dallett Hoopes

[57] ABSTRACT

This invention relates to a nozzle which is capable of selectively dispensing a liquid product as a foam or a spray. A swirl chamber delivers a vortical sheet from the nozzle orifice. The nozzle features a movable chamber which can be moved to a point where it offers no interference with the vortical sheet and thus the spray mode of delivery is effected. The chamber can be moved to a point where interference with the vortical sheet is effected and the formation of a turbulent film is realized. Gas passageways are provided to achieve aeration of the turbulent film and the resultant dispensing of the liquid as a foam.

8 Claims, 4 Drawing Sheets

NOZZLE

BACKGROUND OF THE INVENTION

In the packaging of many liquid household products, e.g., window cleaners, insect poisons, cleaning fluids, etc., it has been found market-attractive to include, as part of the package, a finger actuated dispensing pump. These pumps are generally fitted with nozzles which are capable of product delivery in a spray mode and/or a stream mode. Most nozzles produce the spray mode by causing the liquid product to be broken up into small particles as it is dispensed in a vortical state from the nozzle. The desired vortex is generally formed by forcing the liquid to traverse, while under pressure, a swirling path as the liquid exits the nozzle outlet orifice. The swirling path can b accomplished by the use of any of the well known "swirl chamber" devices which are associated with the nozzle. See for example the devices of U.S. Pat. Nos. 4,358,057; 4,257,751; and 4,161,288.

The spray mode of delivery is preferred over the stream mode in those applications where the product is to be applied evenly over a relatively large area. However, due to the break-up of the liquid, some of the product will be delivered as a fine mist. Also a fine mist can be formed when the product impacts the surface on which it is sprayed. When the product is applied in an enclosed area, e.g., a shower stall, there is the possibility that the user will inhale some of the mist. Thus, the spray mode of delivery, while useful in many applications, is not always desirable.

To overcome the problems created by the fine mist, the pump industry has developed a foam mode of delivery. To achieve foaming of the dispensed product, the nozzles provide for aeration of the product after it leaves the swirl chamber. This aeration can be effected by aspirating air into the nozzle so that the air is entrapped in the small particles of product which have been produced by the swirl chamber. While the foam mode of delivery minimizes the production of the fine mist and is thus desirable for certain applications, the area of coverage achieved by foam delivery is less than the area of coverage which is achievable by the spray delivery. Therefore, as is the case for spray delivery, foam delivery is desirable in many applications but not in all applications.

Since the use of many products dictates the use of spray delivery in some applications and foam delivery in other applications, there is a need for a nozzle which can selectively provide spray delivery or foam delivery. It is therefore an object of this invention to provide such a nozzle.

THE INVENTION

This invention relates to a nozzle which is capable of selectively dispensing a liquid product as a foam or as a spray. The nozzle of this invention is suitable for use with any of the types of dispensing systems which can deliver the liquid product under pressure to the nozzle. Exemplary of such systems are aerosol systems, trigger-actuated pumps, finger-actuated pumps, and the like. The subject nozzle can be mounted to the dispensing stem or to the bore barrel, as the case may be, for any particular dispensing system.

More particularly, the nozzle of this invention includes a passageway through which the liquid to be dispensed can pass to the nozzle while under pressure. The nozzle also includes a mechanical break-up structure, e.g., swirl chamber, which is located in between and in liquid communication with the passageway and a nozzle outlet orifice. The mechanical break-up structure causes the pressurized liquid communicated to it to be dispensed through the nozzle outlet orifice as a swirling conical sheet having sufficient angular velocity to form a substantially hollow conical vortex sheet.

To provide a highly suitable vortex sheet, it has been found that the mechanical break-up structure is preferably of the swirl chamber type. The vortex sheet formation by conventional swirl chambers is well known to those skilled in the art. Any of the swirl chamber configurations presently in the marketplace or disclosed in printed publications are suitable so long as they are capable of forming the before mentioned hollow conical vortex sheet.

Downstream of the nozzle outlet orifice, the subject nozzle provides a hollow first chamber which is open at both of its ends and which is selectively movable between a first position and a second position. At the first position, the first chamber is located, with respect to the nozzle outlet orifice, so that the vortex sheet produced by the mechanical break-up structure will pass through the first chamber without substantial interception by any of the walls of the first chamber. In the first position, therefore, the liquid product is dispensed unaffected by the first chamber and is dispensed as a spray. At the second position, the first chamber is located, with respect to the nozzle outlet orifice, so that the vortex sheet is intercepted by at least one wall of the first chamber to yield a turbulent liquid film on that wall. The formation of the turbulent liquid film coupled with the aspiration of a gas into the nozzle, as hereinafter described, results in the liquid product being dispensed as a foam. The first chamber is preferably an elongated sleeve which is substantially coaxial with the nozzle outlet orifice and is located, when in the second position, with respect to the nozzle outlet orifice so that the base of the vortex will impinge upon the interior surface of the sleeve to form the above mentioned turbulent film.

Aspiration of a gas into the subject nozzle is effected by the formed vortex sheet which provides, at its interior, a pressure which is lower than ambient pressure. This lower pressure results in the gas, e.g., air, being aspirated into the nozzle through one or more gas passageways. The greater the difference between the ambient pressure and the internal vortex pressure, the greater the amount of gas that will be aspirated. Since the availability of aspirated gas is at least partially responsible for the amount of aeration achieved, the amount of foaming of the dispensed liquid is directly affected by the strength of the vortex. Achieving the desired vortex strength is an empirical science and depends upon the pressure which the pump delivers the liquid to the nozzle, the design of the mechanical break-up structure and the physical characteristics of the liquid being dispensed.

The subject nozzle can be configured so that various embodiments of this invention can have one or more gas passageways. In all embodiments, there is one common main passageway which is present. This main passageway is provided by the first chamber and is defined, at least partially, by its interior surfaces. In the second position, the vortex sheet is intercepted within the interior of the first chamber and draws gas into itself and thus towards and into the downstream end of the first chamber. If no other gas passageways are used, then aeration of the turbulent film in the first chamber is achieved solely in this manner. In other embodiments, supplementary gas passageways can be provided which are in gas communication with the vortex sheet and which direct a portion of the total aspirated air into the rear or upstream portion of the vortex sheet. The vortex-produced pressure difference between its interior pressure and ambient pressure provides the driving force for such aspiration. The supplementary gas passageways can extend from the downstream end of the nozzle to the rear of the vortex sheet or can extend from other locations on the nozzle to the rear of the vortex sheet. By having the gas both aspirated towards and into the downstream end of the first chamber and aspirated into the rear of the vortex sheet, high aeration of the liquid product is achieved. In a preferred embodiment, when a supplementary gas passageway is used, it is preferred that the supplementary gas passageway extend from the downstream end of the nozzle to the rear of the vortex sheet and that this supplementary gas passageway be the sole supplementary gas passageway used.

The first chamber is preferably located at least partially within a second chamber. The second chamber is open at its downstream end and may or may not be closed off to gas flow at its upstream end. The second chamber can be used to hold the first chamber in the relationship needed to achieve the first and second positions and/or can be used to form a part of a supplemental gas passageway. When only the above described main gas passageway is used or when the main gas passageway and a supplemental gas passageway, which supplemental gas passageway provides for aspiration of gas to the rear of the vortex sheet via a path extending from the downstream end of the nozzle are used, the second chamber is preferably closed off to air at its upstream end. The second chamber can, however, be open to gas flow at its upstream end in those cases where the supplemental gas passageway includes such an opening to route gas to the rear of the vortex sheet from a location on the nozzle other than its downstream end.

In most cases, it is preferred that the first and said second chamber both be cylindrical and be coaxially located with respect to the nozzle outlet orifice. The outside diameter of the sleeve defining the first chamber and the inside diameter of the sleeve defining the second chamber are preferably dimensioned to obtain a slidable fit therebetween. In the case where only the main gas passageway is used and in the case where the supplemental gas passageway extends to the rear of the vortex sheet from a point other than the downstream end of the nozzle is used, it is preferred that the slidable fit be essentially tight against gas flow therethrough so as to not frustrate the gas flows dictated by these gas passageways designed into the nozzle. If, however, the supplemental gas passageway extends from the downstream end of the nozzle to the rear of the vortex sheet, it is then useful to dimension the first chamber sleeve and the second chamber skirt so that there is a suitable annular space between them which can act as a portion of such a supplemental gas passageway.

To effect movement of the first chamber between the first position and the second position, there is preferably provided moving structure associated with the first chamber which is convenient to use manually to achieve the movement between positions. In those cases where the two chambers are used and the chambers are cylindrical, a preferred moving structure comprises a ring which circumposes the second chamber skirt and which is connected to the first chamber sleeve by at least one radially and inwardly extending connecting arm. The ring, since it is on the outside of the second chamber skirt, will be easily accessible for grasping. Other moving structures are also suitable, e.g., the first chamber sleeve could be threaded to the second chamber skirt and obtainment of the first and second positions would be simply achieved by threading or unthreading the first chamber cylinder.

It has been found that the longer the turbulent film is exposed to the aspirated gas, the greater the aeration of the dispensed liquid and thus, the greater its foam characteristic. This time of exposure is easily controlled by dimensioning the length of the first chamber. As is the case in determining suitable vortex strength, the determination of optimal first chamber length is an empirical science. Factors affecting suitable length are the amount of available aspirated gas and the physical characteristics of the liquid, e.g., surface tension, viscosity, etc. It should be noted, however, that the first chamber should not be of excessive length or the aerated liquid may not be dispensed therefrom with a force sufficient to satisfy the user's purposes. Generally speaking, suitable first chambers have a length within the range of from about 0.100 to about 0.750 inches and an average inside cross sectional width within the range from about 0.120 to about 0.500 inches. (When the first chamber is a hollow cylinder, the inside width will be the inside diameter of the cylinder.) For most commercial applications, a preferred first chamber will be a cylinder having a length within the range from about 0.100 to about 0.250 inches and a diameter within the range from about 0.120 to about 0.240 inches.

When the first and second chambers are configured to achieve the before mentioned gas-tight slidable fit, the second chamber will, generally speaking, have a length in the range of from about 0.200 to about 0.700 inches and an average inside cross sectional width which is equal to or very nearly equal to the outside dimensions of the first chamber surfaces which are in slidable contact with the second chamber. Thus, when the second chamber is a hollow cylinder, its inside diameter will be essentially the outside diameter of the first chamber cylinder. Preferred dimensions for the second chamber, for use with the above described preferred first chamber, are a length within the range of from about 0.250 to about 0.500 inches and a diameter within the range of from about 0.250 to about 0.500 inches.

The supplemental gas passageways discussed above should be fairly open so as to not frustrate the aspiration of air therethrough. Generally, a supplemental air passageway should provide a cross-sectional area to flow within the range of from about 0.005 to about 0.05 square inches. Most commercial applications can use from about 0.02 to about 0.04 square inches.

The nozzle of this invention can be conveniently formed by injection molding and from thermoplastic materials such as polypropylene, polyethylene, polyethylene terephthalate, etc.

These and other features of this invention contributing to satisfaction in use and economy in manufacture will be more fully understood from the following description of preferred embodiments of this invention and the accompanying drawings in which:

FIG. 1 in a vertical sectional view of the nozzle body and swirl chamber shown in FIG. 10;

Figure 1:
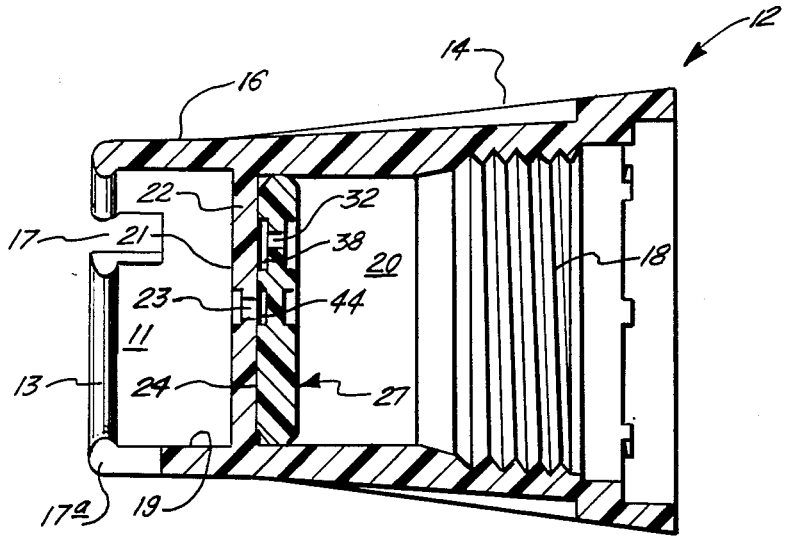
Figure 10:
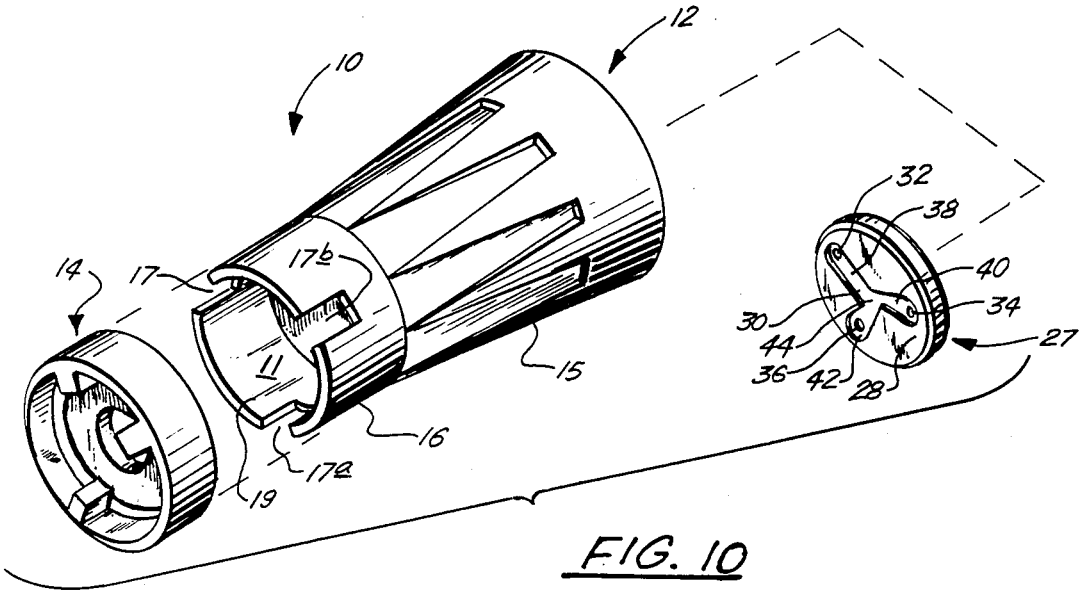
FIG. 10 is an exploded view of a nozzle of this invention.

Referring now to FIGS. 1 and 10, there can be seen a nozzle of this invention, generally designated by the numeral 10 which includes a nozzle body 12, a swirl chamber button 27 and a foamer 14. The nozzle body 12 has a frusto-conical portion 15 and a cylindrical portion 16. As is shown in FIG. 1, there is a helical thread 18 about the inside wall of the upstream end of frusto-conical portion 15. Helical thread 18 is for threaded cooperation with a complimentary thread found about the terminal end of a bore barrel used on a helical thread 18 is liquid passage 20. Liquid passage 20 will be filled with pressurized liquid which is fed through the bore of a pumping device upon its actuation.

At the downstream end of liquid passage 20 is wall 22. Wall 22 has a planar surface 24 which faces into liquid passage 20 and a planar surface 21 which faces downstream. Nozzle exit orifice 23 traverses wall 22. Extending from and downstream of wall 22 is skirt 16 which has a cylindrical inside surface 19 which defines a chamber which is herein referred to as second chamber. At the downstream end of surface 19 is annular snap bead 13. Also, extending from the downstream end of skirt 16 towards an upstream location are slots 17, 17*a* and 17*b* which are equiangularly displaced from one another.

Figure 2:
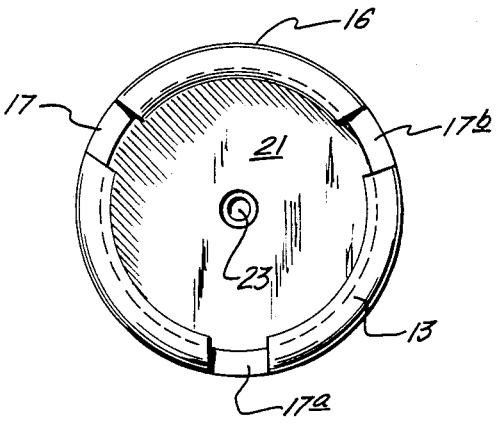
FIG. 2 is a front end view of the nozzle body shown in FIG. 10.

To effect the formation of a vortex comprised of a swirling conical sheet of liquid, there is provided swirl chamber button 27. For the embodiment shown in the Figures, swirl chamber button 27 is a second piece of nozzle 10. It is to be understood, however, that an integral swirl chamber or other mechanical break-up device can be used and that either of them may be provided as molded-in components of nozzle 10 and need not be provided separately as is done for the instant embodiments. Button 27 is dimensioned to have a diameter so that it can be snugly nested within liquid passage 20 as shown in FIG. 2. Swirl chamber button 27 has a planar face 28. Within planar face 28 is swirl camber cavity 30 which is comprised of swirl chamber arms 38, 40 and 42 which are tangentially located with respect to center portion 44. The configuration of swirl chamber cavity 30 is conventional and is not critical to the operation of the nozzle of this invention so long as the chosen configuration provides the necessary vortex. To communicate liquid from liquid passage invention so long as the chosen configuration provides the necessary vortex. To communicate liquid from liquid passage 20 to swirl chamber cavity 30, there is provided at the outmost extent of swirl chamber arms 38, 40 and 42 entrance ports 32, 34 and 36 respectively. As can be seen in FIG. 2, when swirl chamber cavity 30 achieves an abutting relationship with planar surface 24, a swirl chamber is created. Liquid entering into this formed swirl chamber under pressure will be required to take a swirling path which effects the formation of the desired vortex. Note further that in FIG. 2 that nozzle exit orifice 23 is located to overlie center portion 44 of swirl chamber cavity 30. It is from center portion 44 that the swirled liquid will exit through nozzle exit orifice 23.

It is desirable, from an assembly point of view, that swirl chamber button 27 have an identical configuration on its other planar face which is opposite planar face 28. The advantage of providing swirl chamber button 27 with identical swirl chamber cavities on its opposite faces is that the swirl chamber button can be readily assembled within nozzle body 12 without regard to which side of the button is placed in abuttment with planar surface 24.

Figure 3:
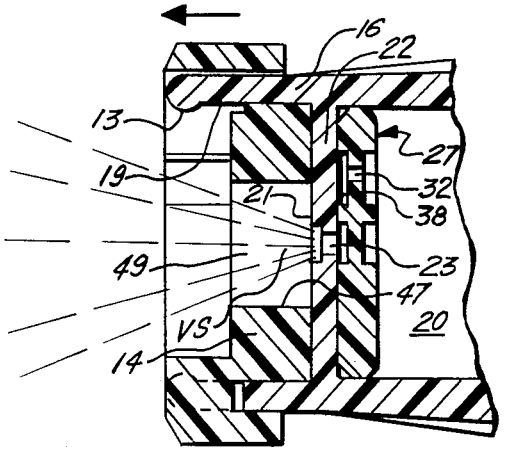
FIG. 3 is a partial vertical sectional view of the nozzle shown in FIG. 10 with the foamer of FIG. 4 in a first position.
Figure 4:
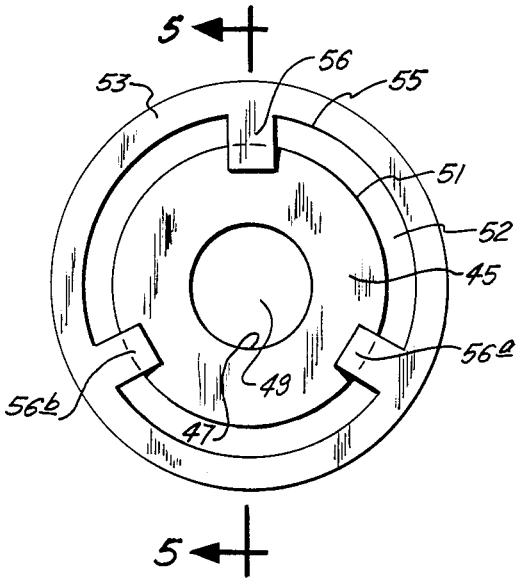
FIG. 4 is a front end view of the foamer shown in FIG. 10.
Figure 5:
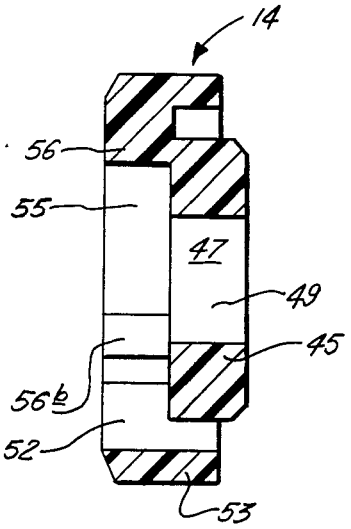
FIG. 5 is a sectional view taken through section lines 5—5 in FIG. 4.
Figure 8:
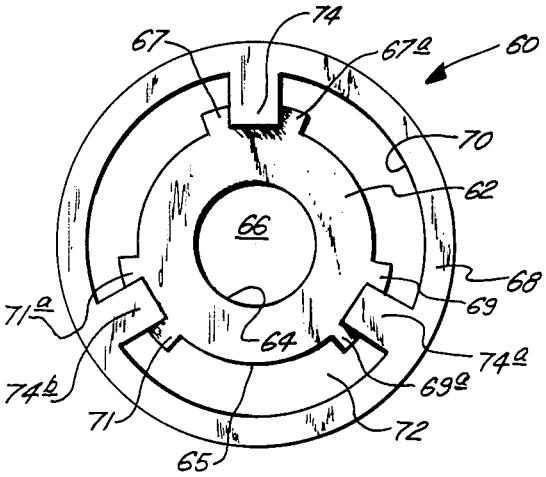
FIG. 8 is a front end view of a second foamer for use with the nozzle body shown in FIG. 10.
Figure 6:
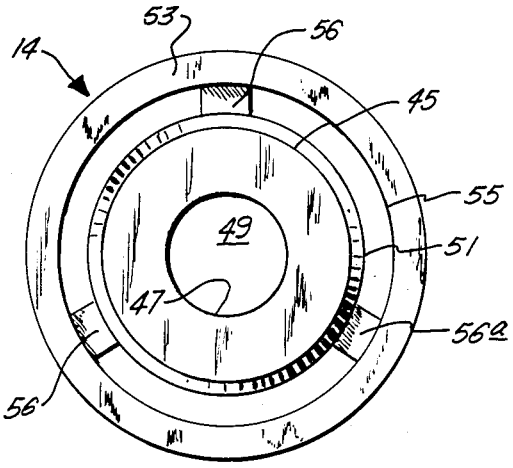
FIG. 6 is a rear end view of the foamer shown in FIG. 4.
Figure 7:
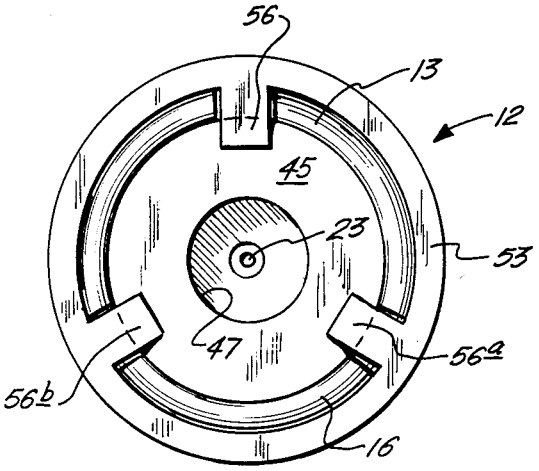
FIG. 7 is a front end view of the foamer shown in FIG. 4 mounted to the nozzle body shown in FIG. 10.
Figure 11:
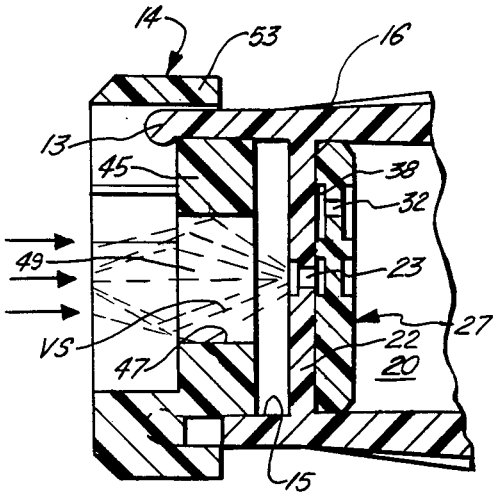
FIG. 11 is a partial vertical sectional view of the nozzle shown in FIG. 10 with the foamer of FIG. 4 in a second position.

Referring now to FIGS. 4–6 wherein foamer 14 is shown to comprise annulus or sleeve 45 having an inside surface 47 which defines a first chamber 49. Attached to sleeve 45 by way of arms 56, 56*a* and 56*b* is ring 53. As can be seen, the inside surface 55 of ring 53 has a diameter larger than the outside surface 51 of sleeve 45 whereby an annular space 52 is provided. For the embodiment shown in FIGS. 4–6, annular space 52 is dimensioned so as to accommodate the downstream end of skirt 16 of nozzle body 12 as is shown in FIGS. 3, 7, and 11. In another embodiment, the foamer can be configured so as to provide for a supplementary air passageway as hereinafter described. In FIG. 8, this second embodiment of a foamer is generally indicated by the numeral 60. Foamer 60 comprises a sleeve 62 having an inside surface 64 which defines a first chamber 66. Ring 68 is connected to sleeve 62 by way of connecting arms 74, 74*a* and 74*b*. Ring 68 has an inside surface 70. As can be seen in FIG. 8, cylinder 62 has, adjacent the various connecting arms, tabs 67, 67*a*, 69, 69*a*, 71 and 71*a*. The distance between the outside surface 65 of sleeve 62 and the inside surface 70 of ring 68 between these tabs is sufficiently large to accommodate the downstream end of skirt portion 16 of nozzle body 12 and to provide for an annular space therebetween. The tabs are dimensioned so as to enable a snap fit with annular snap bead 13 and a slidable fit with the inside wall of cylindrical portion 16 as hereinafter described.

To assemble nozzle 10, swirl chamber button 27 is nested against planar surface 24 as is shown in FIG. 1 so as to provide a closed swirling pathway for the pressurized liquid as it is delivered to the nozzle. As previously pointed out, the swirling passageway causes the liquid to be dispensed through exit orifice 23 in a swirling pattern which is of sufficient angular velocity to provide a vortex capable of aspirating air into nozzle 10.

FIG. 7 shows the assembly of the foamer of FIGS. 4–6 and nozzle body 12. This assembly is achieved by simply pressing foamer 14 into second chamber 11 over snap bead 13. Since the inside diameter of snap bead 13 is slightly less than the outside diameter of sleeve 45, the passage of sleeve 45 to a point downstream of snap bead 13 effectively locks foamer 14 to nozzle body 12. Also as can be seen in FIGS. 3, 7, and 11, the outside diameter of sleeve 45 is substantially equal to the diameter of cylindrical inside surface 19. Thus, cylindrical inside surface 19 is in a tight slidable fit with the outside surface 51 of sleeve 45. This slidable fit is essentially gas-tight so that little or no air is aspirated between the fit during operation of nozzle 10.

Figure 9:
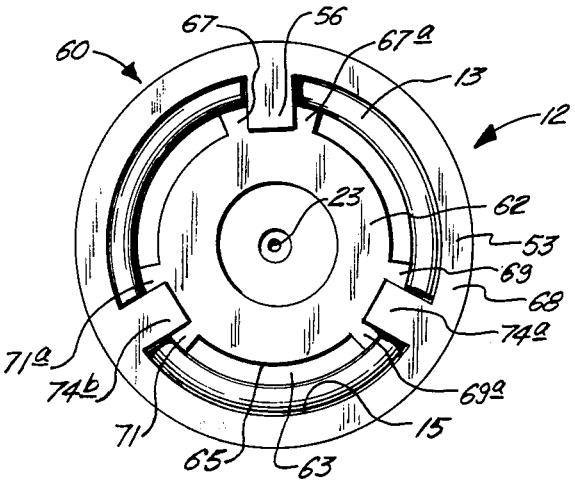
FIG. 9 is a front end view of the second foamer shown in FIG. 8 mounted to the nozzle body shown in FIG. 10.

For the foamer embodiment shown in FIGS. 8 and 9, foamer 60 is mounted to nozzle body 12 in a manner similar to that for the previously described embodiment, that is, foamer 60 is pressed into second chamber 11 so that tabs 67, 67*a*, 69, 69*a*, 71 and 71*a*, pass over snap bead 13 to the downstream side of snap bead 13. Since the diameters defined by the tabs is such that they exceed the inside diameter of snap bead 13, foamer 60 is locked to nozzle body 12. Once mounted to nozzle body 12, foamer 60 provides an annular supplementary air passageway 63, shown in FIG. 9, which is at least partially defined by outside surface 65 of sleeve 62 and the inside surface 19 of skirt 16 of nozzle body 12.

In operation, the nozzles of this invention are capable of providing the dispensing of a liquid product either as a spray or as a foam. For foamer 14, reference is made to FIGS. 3 and 11.

To achieve the spray mode of operation, foamer 14 is moved upstream to the first position shown in FIG. 3. The movement between the first and second positions shown in FIG. 3 and FIG. 11, respectively, is easily achieved by grasping ring 53 between the fingers and moving foamer 14 to the location desired. In the first position, foamer 14 is in an upstream position in which foamer 14 abuts wall 22. As can be seen in FIG. 3, vortex sheet VS is not intercepted by or does not make substantial contact with the inside surface 47 and thus passes through sleeve 45 without interference. With sleeve 45 out of the way and not providing interference to vortex sheet VS, the spray mode of delivery is achieved.

In FIG. 11 sleeve 45 is shown moved to second position so that vortical sheet VS which is being dispensed through nozzle outlet orifice 23 comes into contact with inside surface 47 of sleeve 14 thereby forming a turbulent film thereon. Aspirated air, as shown in FIG. 11, is aspirated towards and into first chamber 49 due to the difference between ambient pressure and the air pressure within first chamber 49 resulting from the presence of a vortex in such chamber. The aspirated air mixes with the turbulent film to produce a foamed product which is dispensed from the nozzle by continued discharge of product through nozzle exit orifice 23. As previously mentioned, outside surface 51 of foamer 14 sleeve 45 (FIG. 4) is dimensioned so that a tight slidable fit is provided between outside surface 51 and surface 19. Thus, for foamer 14, most, if not all, of the air aspirated into first chamber 49 is achieved by air being drawn into chamber 49 from the downstream end of the nozzle. With foamer 14 in the position shown in FIG. 11, it is possible to modify skirt 16 of nozzle body 12 so that at least one supplemental air passageway can be provided for and so that supplemental air can be aspirated into the rear of first chamber 49 to enhance aeration of the turbulent film. The supplemental air passageway(s) can be easily provided for by the use of holes which extend through skirt 16 at a location between wall 22 and the upstream end of sleeve 45. These holes are not shown in the drawings but illustrate a simple-to-obtain modification of skirt 16 to provide for aspiration of supplemental air into nozzle 10.

Figure 13:
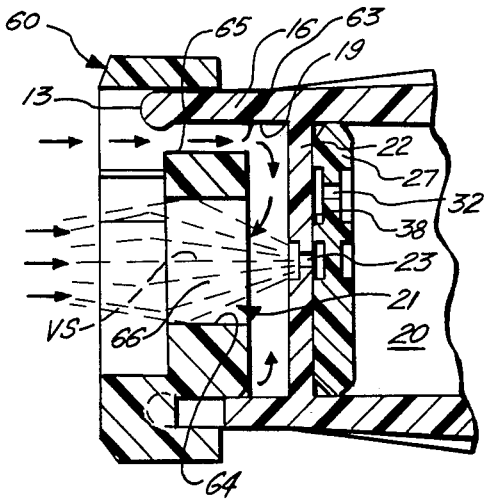
FIG. 13 is a partial vertical sectional view of the nozzle shown in FIG. 10 with the foamer of FIG. 8 in a second position.
Figure 12:
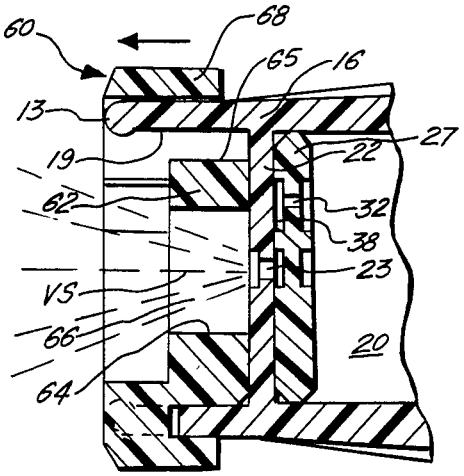
FIG. 12 is a partial vertical sectional view of the nozzle shown in FIG. 10 with the foamer of FIG. 8 in a first position.

For the other foamer embodiment, i.e., foamer 60, reference is made to FIGS. 12 and 13, the former illustrating the first position and the latter illustrating the second position. In FIG. 12, first chamber 66 is moved to the first position so that sleeve 62 is in abutment with planar surface 21 of wall 22. In this position, sleeve 62 is located so as to be out of the way of vortical sheet VS and to thus avoid the impingement of vortical sheet VS on inside surface 64. The liquid dispensed is dispensed as a spray which is provided for by swirl chamber button 27.

In FIG. 13, foamer 60 is in the second position. Being so located, vortical sheet VS impinges, at its base, upon inside surface 64 of sleeve 62 to form a turbulent film. Vortical sheet VS produces at its interior a lower pressure than ambient pressure and therefore aspirates alr into and towards first chamber 66. Supplemental air is also aspirated through supplemental passageway 63 and is directed into the rear of vortical sheet VS. Supplemental passageway 63 is defined by outside surface 65 of sleeve 62 and inside surface 19 of skirt 16 and by that portion of planar surface 21 which is opposite the upstreammost extent of sleeve 62. The provision of supplemental air is beneficial in increasing the aeration of the turbulent film formed by the impingement of vortical sheet VS on the inside surface 64.

Foamer 60 is moved between the positions shown in FIGS. 12 and 13 by manually grasping ring 68 and moving the foamer either upstream or downstream as the indicated position requires.

We claim:

1. A nozzle for selectively dispensing a liquid as a foam or a spray, which nozzle comprises:
   (a) a passage means through which the liquid to be dispensed can pass while under pressure;
   (b) a transverse wall in the passage means having a swirl chamber communicating with the passage means, the chamber having a nozzle outlet orifice, said swirl chamber causing at least a portion of the liquid communicated to it through said passage means to be dispensed through said nozzle outlet orifice as a swirling conical sheet having sufficient angular velocity to form a substantially hollow conical vortex, which vortex aspirates air into said nozzle;
   (c) a skirt circumposing the orifice and extending out from the wall but not far enough to be impinged by the vortex; and
   (d) a sleeve which is in slideably telescoping relation with the skirt and is movable between a first position and a second position, said first position being located, with respect to said nozzle outlet orifice, whereby said vortex passes through said sleeve without substantial impingement on the inside of said sleeve, said second position being located, with respect to said nozzle outlet orifice, whereby the inside of the sleeve is substantially impinged upon by the vortex, thereby yielding a turbulent film of said liquid on the inside of said sleeve.

2. The nozzle of claim 1 wherein said skirt and sleeve between them define an air passageway through which aspirated air is directed into the rear of said vortex when said sleeve is in said second position.

3. The nozzle of claim 2 wherein the inside wall of said sleeve has a diameter greater than the diameter of the outside wall of said skirt, said inside wall of said skirt and said outside wall of said sleeve defining at least a portion of the gas passageway through which aspirated air is directed into the rear of said vortex when said sleeve is in said second position.

4. The nozzle of claim 1 wherein said nozzle additionally includes a moving means whereby said sleeve is manually movable between said first and second positions.

5. The nozzle of claim 4 wherein said moving means comprises a ring which is coaxial with and circumposes said skirt and which is connected to said sleeve by at least one inwardly and radially extending connecting arm.

6. The nozzle of claim 5 wherein the skirt is formed with at least one longitudinal slot and the arm extends through said slot.

7. A nozzle adapted to discharge liquid in either a foam or spray comprising (a) a nozzle body adapted to be connected to the outlet of a discharge stream under pressure and having a transverse wall incorporating swirl chamber means terminating in a discharge orifice delivering a hollow spray vortex, (b) a short skirt surrounding the orifice and extending outward therefrom and being integrally formed with the body, the skirt not extending outward sufficiently to intercept the spray vortex, and being formed with circumferentially spaced longitudinal slits, (c) a foam-producing sleeve concentrically disposed inside the skirt and surrounding the orifice, and said sleeve when in an inward position having an inside surface which is of greater diameter than an outer portion of the spray vortex, and said sleeve having integral radially outward arms extending through the slots and a ring integral with the arms and sleeve and slideably telescoped over the skirt, whereby the ring can be manually moved outward and inward on the skirt so that the spray impinges or not on the inside of the sleeve and produces a foam discharge or alternatively emanates from the nozzle as a spray vortex.

8. A nozzle of claim 7 wherein the skirt and sleeve between them have detent means which retains the sleeve on the skirt.

* * * * *